US006296454B1

(12) United States Patent
Schmid et al.

(10) Patent No.: US 6,296,454 B1
(45) Date of Patent: Oct. 2, 2001

(54) SUCTION JET PUMP HAVING AN INLET DIFFUSER WITH AN ELLIPTICAL INFLOW CONE

(75) Inventors: René Schmid, Eschborn; Joachim Lepper, Wehrheim; Wolfgang Planck, Rüsselsheim; Ludger Kürmann, Eschborn, all of (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/448,739

(22) Filed: Nov. 24, 1999

(30) Foreign Application Priority Data

Nov. 27, 1998 (DE) ..... 198 55 433

(51) Int. Cl.[7] ..... F04F 5/44
(52) U.S. Cl. ..... 417/151; 417/198
(58) Field of Search ..... 417/198, 151; 239/590, 590.3, 590.5, 592, 597, 601, 548, 553, 553.5, 553.3

(56) References Cited

U.S. PATENT DOCUMENTS

| | | | | |
|---|---|---|---|---|
| 1,151,259 | * | 8/1915 | Fischer | 239/548 |
| 1,936,246 | * | 11/1933 | Carter et al. | 417/197 |
| 2,210,846 | * | 8/1940 | Aghnides | 239/548 |
| 2,619,388 | * | 11/1952 | Wahlin | 239/597 |
| 2,780,436 | * | 2/1957 | Holzwarth | 239/597 |
| 4,141,701 | * | 2/1979 | Ewan et al. | 55/90 |
| 4,311,291 | * | 1/1982 | Gilbertson et al. | 239/601 |
| 4,470,177 | * | 9/1984 | Ganung et al. | 24/270 |
| 4,519,423 | * | 5/1985 | Ho et al. | 417/198 |
| 4,834,132 | | 5/1989 | Sasaki et al. . | |
| 4,957,242 | * | 9/1990 | Schadow et al. | 239/590 |
| 5,664,733 | * | 9/1997 | Lott | 239/601 |

FOREIGN PATENT DOCUMENTS

| | | |
|---|---|---|
| 255933 | 1/1913 | (DE) . |
| 365097 | 12/1922 | (DE) . |
| 2823604 A1 | 12/1978 | (DE) . |
| 19530423 A1 | 2/1997 | (DE) . |
| 1322578 | 5/1962 | (FR) . |
| 2086787 | 4/1970 | (FR) . |
| 2078302 A | 1/1982 | (GB) . |

* cited by examiner

*Primary Examiner*—Cheryl J. Tyler
(74) *Attorney, Agent, or Firm*—Richard A. Speer; Mayer, Brown & Platt

(57) ABSTRACT

A suction jet nozzle and a diffuser having an inflow cone with an elliptical cross-section is implemented in a suction jet pump to be used in a motor vehicle's fuel tank. The jet nozzle is configured to produce a flat propulsion jet that seals the diffuser over its entire circumference.

6 Claims, 2 Drawing Sheets

SUCTION JET PUMP HAVING AN INLET DIFFUSER WITH AN ELLIPTICAL INFLOW CONE

BACKGROUND OF THE INVENTION

The subject of the invention is a suction jet pump with an improved suction action. Suction jet pumps are used, for example, in fuel tanks of motor vehicles, in order to convey fuel out of one region of the fuel tank into another region.

Suction jet pumps are nowadays employed in fuel tanks of motor vehicles and are therefore known. They have the task of conveying fuel out of distant and lower regions of the fuel tank to the feed unit or into a baffle. The suction jet pump consists, in this case, essentially of a propulsion jet tube, an intake orifice and a mixing tube. The liquid quantity supplied to the suction jet pump via the propulsion jet tube emerges under pressure from the propulsion jet nozzle delimiting the propulsion jet tube and subsequently enters the mixing tube. The intake orifice for the liquid to be conveyed is arranged between the propulsion jet nozzle and the mixing tube. The propulsion jet entering the mixing tube generates a vacuum upstream of the latter, so that the liquid to be conveyed is sucked into the mixing tube via the intake orifice. The efficiency of a suction jet pump, in this case, depends on many factors. Thus, for example, the length of the mixing tube and other geometric factors influence the efficiency. The general disadvantage of suction jet pumps is their relatively low efficiency of about 20 to 30%.

It is known that a good suction action is achieved if the mixing tube length amounts to more than ten times the mixing tube diameter. On account of the conditions of space in a fuel tank, however, precisely these geometric requirements often cannot be implemented, so that the efficiency, which is low in any case, is impaired even further.

The object on which this invention is based is, therefore, to provide a suction jet pump with improved suction action, which has a simple design and does not take up a large construction space.

BRIEF SUMMARY OF THE INVENTION

It was found, surprisingly, that the problem on which the invention is based is solved by means of a suction jet pump, the propulsion jet nozzle and diffuser of which are designed in such a way that, as early as in the diffuser, the propulsion jet is laid completely onto the circumference of the latter. This results in a very rapid liquid seal which leads to a very high vacuum. It is essential to the invention that the propulsion jet nozzle and the diffuser be coordinated with one another. In particular, the shape of the propulsion jet nozzle makes it possible to widen the propulsion jet just after it has left the propulsion jet nozzle.

The advantage of the suction jet pump according to the invention is its suction action which is improved as compared with known suction jet pumps, and which is attributed to the rapid liquid seal in the diffuser. Furthermore, the suction jet pump has a very simple design and takes up little space.

In a particularly advantageous refinement, the nozzle orifice of the propulsion jet nozzle is designed in such a way that it generates a flat jet. In this case, the diffuser possesses an elliptical inflow cone adapted to the flat jet.

It is particularly advantageous to have a nozzle orifice which possesses a notch running transversely. The propulsion jet is thereby widened into a fanlike manner. In other refinements, a web is arranged in the nozzle orifice, said web dividing the propulsion jet and thus generating the flat jet. It may also be envisaged, however, to have a nozzle orifice possessing a plurality of orifices arranged in a line, so that the individual jets form themselves into a flat jet.

A likewise rapid liquid seal in the mixing tube is achieved when the axis of the propulsion jet nozzle is at a small angle to the axis of the mixing tube. As a result, the propulsion jet does not impinge onto the mixing tube axially, but obliquely. This increase in the impingement angle results in even more rapid sealing-off of liquid in the mixing tube, in order thereby likewise to lead to an improved suction action.

DETAILED DESCRIPTION OF THE DRAWING

The invention is explained in more detail by means of an exemplary embodiment. In this context, FIG. 1 of the figures shows a section through a suction jet pump according to the invention and FIG. 2 a top view of the mixing tube with an elliptic diffuser.

Figure 1:
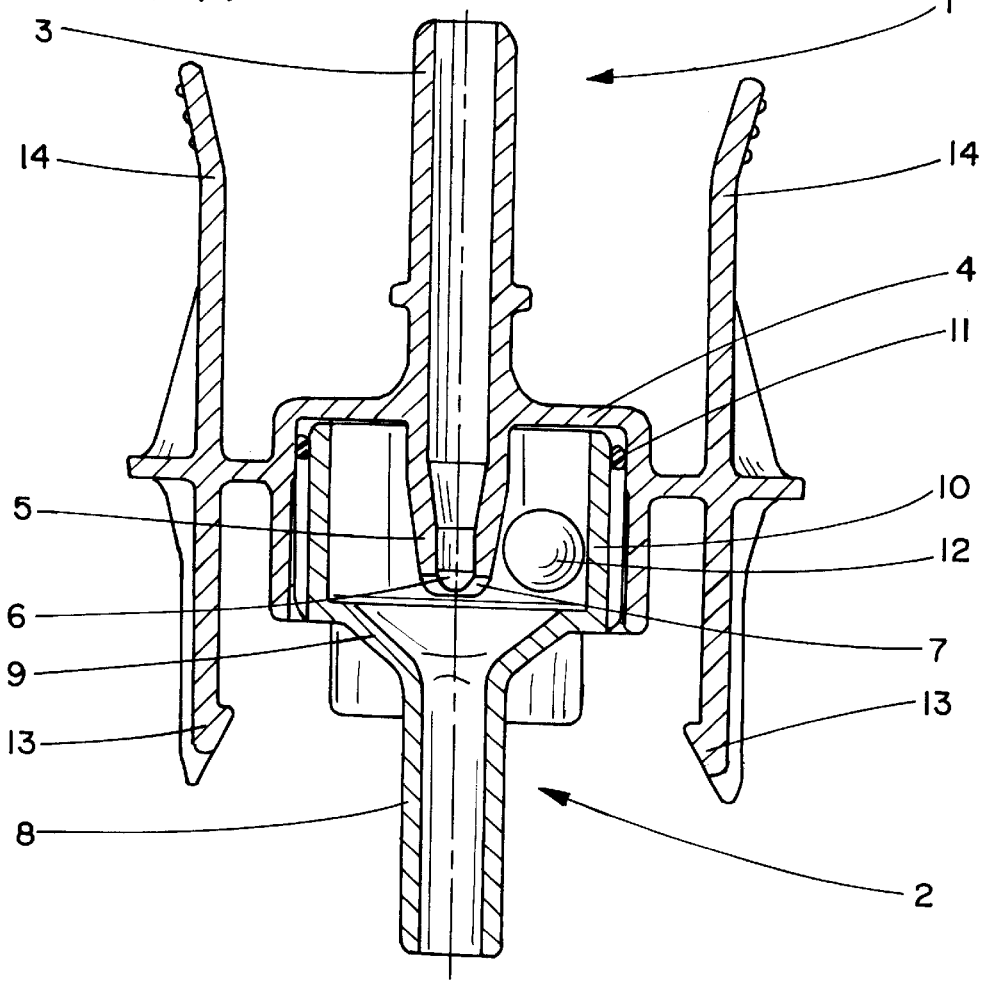
FIG. 1 is a cross-section view through a pump according to the invention.

The suction jet pump illustrated in FIG. 1 consists of an upper part 1 and of a lower part 2. The upper part 1 possesses a connection piece 3 for a propulsion jet line, not illustrated, through which the propellant is supplied to the suction jet pump. The connection piece 3 is surrounded by an outer housing part 4. The propulsion jet nozzle 5 with its nozzle orifice 6 adjoins the connection piece 3. A notch 7 running transversely causes the fanlike widening of the propulsion jet. The lower part 2 of the suction jet pump is formed by the mixing tube 8 and the diffuser 9, the diffuser 9 merging into an inner housing part 10. This inner housing part 10 is pushed in an interlocking manner into the outer housing part 4 and is sealingly connected to the upper part 1 by means of a sealing ring 11. Arranged on the circumference of the inner housing part 10 is a connection piece 12 which forms the intake orifice and via which liquid is sucked into the suction jet pump and conveyed via the mixing tube into a line likewise not illustrated. For simple mounting of the suction jet pump, two resilient catch hooks 13 are integrally formed on the upper part 1 and can be deflected as a result of the actuation of the spring arms 14.

Figure 2:
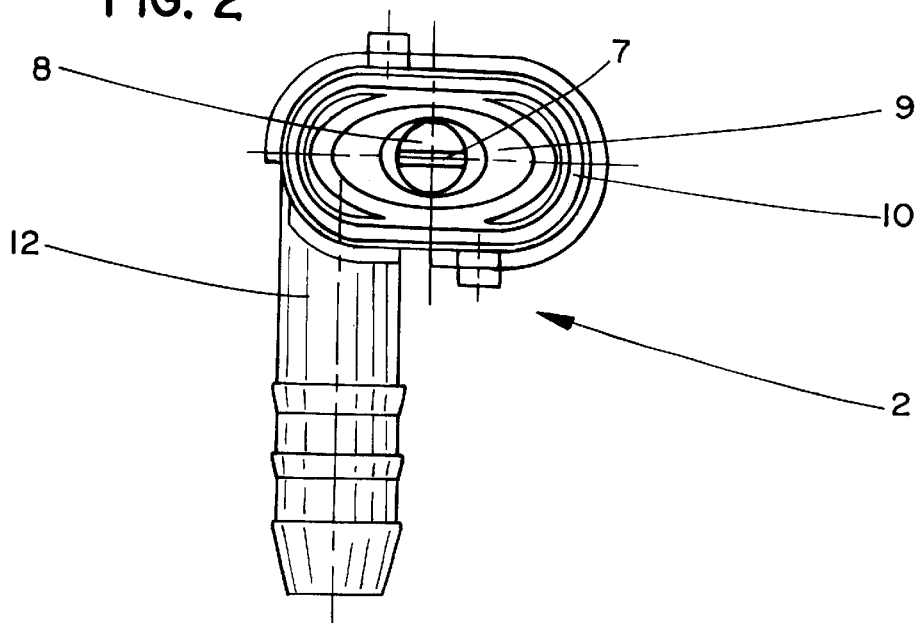
FIG. 2 is a top elevation of a portion of the pump of FIG. 1.

FIG. 2 shows the lower part 2 with the inner housing part 10 and with elliptically designed diffuser 9 which merges into the cylindrical mixing tube 8. The connection piece 12 is arranged at an angle of 90° to the inner housing part 10.

Figure 3:
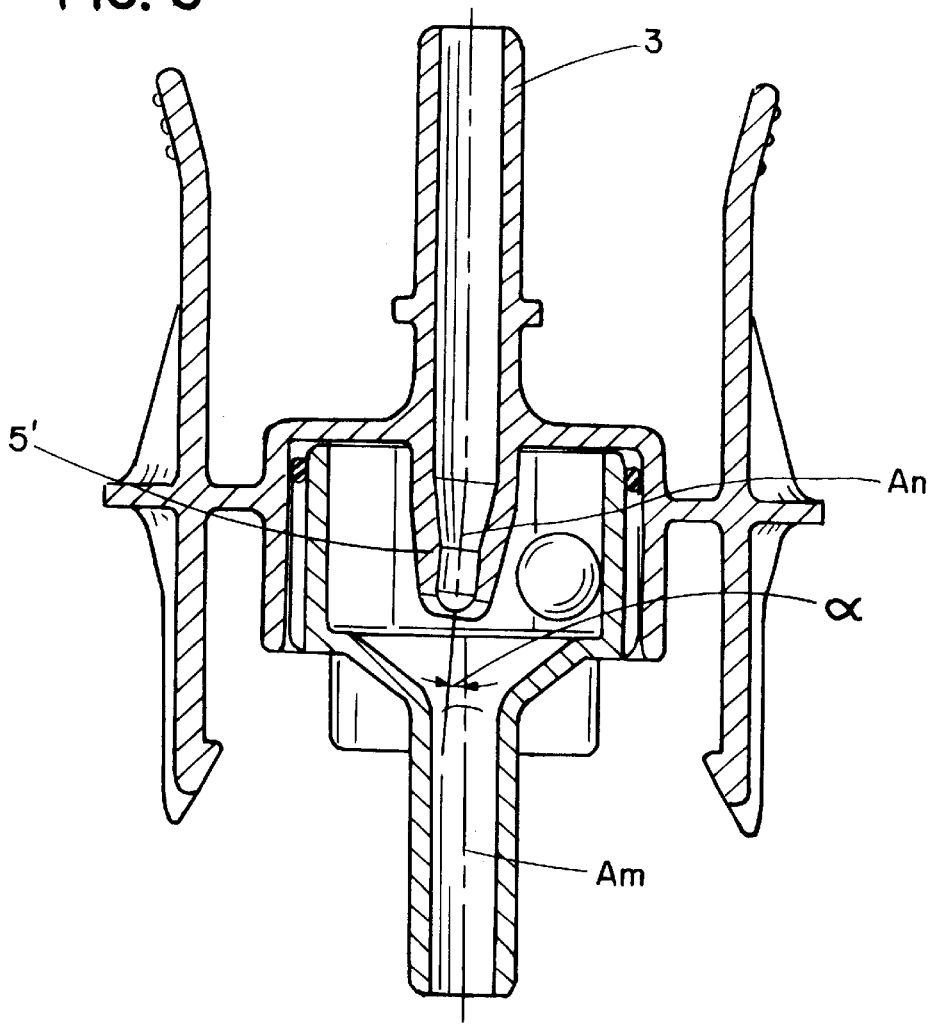
FIG. 3 is a cross-section view through another pump configuration according to this invention.

FIG. 3 shows a suction jet pump like that shown in FIG. 1 in which the propulsion jet nozzle 5' of connection piece 3 is modified so that the axis $A_n$ of the nozzle is a small angle $\alpha$ with respect to axis $A_m$ of the mixing tube 8.

Figure 4:
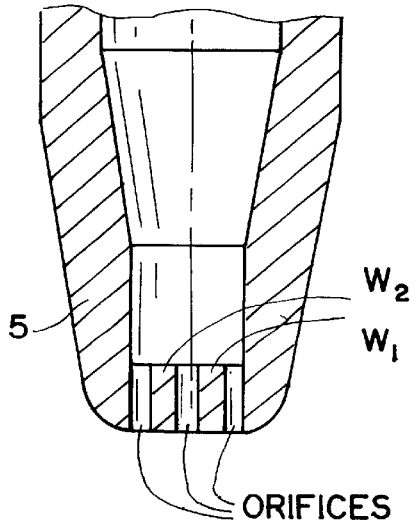
FIG. 4 is a cross-section view of another nozzle configuration for producing a flat jet.
Figure 5:
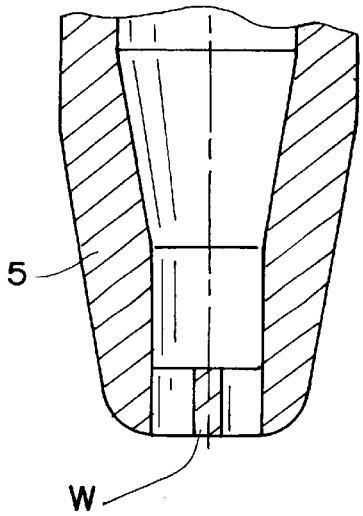
FIG. 5 is a cross-section view of another nozzle configuration.

FIGS. 4 and 5 show arrangements by which the nozzle 5 can be constructed with jet dividing webs that create generation of flat jets Specifically, as shown in FIG. 5, a single transversely extending web W divides the propulsion jet into two orifices and in this manner produces a flat jet. In the construction of FIG. 4, the nozzle is given two webs $W_1$, $W_2$ to thereby establish three orifices arranged in a line so that the individual jets form themselves into a flat jet.

What we claim is:

1. A suction jet pump comprising:

(a) a housing;

(b) a mixing tube having an entrance diffuser formed by an inflow cone whose cross-sectional shape is an ellipse having two foci; and (c) a propulsion jet nozzle located within the housing and configured to produce a flat propulsion jet that seals the diffuser over its entire circumference when introduced there into.

2. The suction jet pump as claimed in claim 1, wherein the nozzle orifice (6) of the propulsion jet nozzle (5) possesses a notch (7) running transversely.

3. The suction jet pump as claimed in claim 1, wherein a web for splitting the propulsion jet is arranged in the nozzle orifice (6) of the propulsion jet nozzle (5).

4. The suction jet pump as claimed in claim 1, wherein the nozzle orifice (6) of the propulsion jet nozzle (5) is formed from a plurality of orifices lying in a line.

5. A suction jet pump comprising:

(a) a housing;

(b) a mixing tube having an entrance diffuser formed by an elliptical inflow cone having two foci; and (c) a propulsion jet nozzle wherein the axis of the jet nozzle is arranged at an angle with respect to the axis of the mixing tube.

6. A suction jet pump comprising:

(a) means for defining a housing;

(b) means located within the housing for producing a flat propulsion jet; and (c) means defining a diffuser having a surface defining an elipitcal inflow cone having two foci for receiving the flat propulsion jet, whereby the jet seals the diffuser over its entire circumference.

* * * * *